United States Patent [19]

Hornbostel et al.

[11] Patent Number: 4,713,150

[45] Date of Patent: Dec. 15, 1987

[54] PROCESS FOR PREPARING A PART FOR COLOR ANODIZATION

[75] Inventors: Lloyd Hornbostel, Beloit; Dale Butrymowicz, Janesville, both of Wis.

[73] Assignee: Parker Pen Ltd., East Sussex, England

[21] Appl. No.: 796,195

[22] Filed: Nov. 8, 1985

[51] Int. Cl.[4] ..... C23C 28/00

[52] U.S. Cl. ..... 204/38.3; 204/38.6; 204/38.7; 204/56.1

[58] Field of Search ..... 204/37.6, 38.3, 38.1, 204/38.6, 38.7, 56.1

[56] References Cited

U.S. PATENT DOCUMENTS

| | | | |
|---|---|---|---|
| 3,493,475 | 2/1970 | Neugebauer et al. | 204/33 |
| 3,784,452 | 1/1974 | Martens et al. | 204/26 |
| 3,806,430 | 4/1974 | Laibowitz et al. | 204/32.1 |

*Primary Examiner*—John F. Niebling
*Assistant Examiner*—William T. Leader
*Attorney, Agent, or Firm*—Edmond T. Patnaude

[57] ABSTRACT

An article of manufacture having a metallic surface consisting of brass or stainless steel is overcoated with a first layer of nickel and a second layer of elemental niobium. The article may thereafter be color anodized in a solution of ammonium sulfate without the need for a hydrofluoric acid etch to produce a highly attractive and colorful ornamental surface finish. After anodization, the articles may be coated with clear epoxy or a sputter deposited transparent ceramic coating for added wear resistance.

5 Claims, No Drawings

PROCESS FOR PREPARING A PART FOR COLOR ANODIZATION

BACKGROUND OF THE INVENTION

A. Field of the Invention

This invention generally relates to the art of providing an ornamental surface coating on an article of manufacture and, more particularly, the invention relates to preparing a metallic substrate for receiving a durable and ornamental surface coating.

B. Description of the Prior Art

Articles of manufacture having exposed ornamental metallic surfaces are well known in a variety of applications, such as jewelry or other personal accessories and furnishings, for example. In such applications, gold has been widely used as a surface coating because of its attractive appearance and corrosion resistance. Since precious metals, generally, are expensive to use as coatings for articles of manufacture, various techniques and substitute coatings have been developed which provide a less expensive but attractive external surface for such articles. For example, titanium nitride can be deposited on a metal substrate through the use of either physical or chemical vapor deposition techniques such that ornamental surface finishes may be achieved without the expense of using precious metals. Such a technique is disclosed in U.S. Pat. No. 4,252,862, issued to Nishida on Feb. 24, 1981.

A metallic surface finish which has recently become widely accepted for its pleasing, colorful appearance is a so-called "rainbow" finish. A rainbow finish may be achieved by a chemical anodization process wherein a preparation of a ten percent by weight ammonium sulfate solution in distilled water is placed in a suitable metallic container having means to heat the solution to between 120 and 140 degrees Fahrenheit and a variable DC voltage is applied with the tank serving essentially as the cathode and the part to be anodized serving essentially as the anode. The color patterns created in such a process is a function of the applied voltage and a working range of between 30 and 105 VDC is appropriate. As an alternative to the chemical anodization bath, brush plating may be used to provide surface color patterns by saturating the brush in the aforesaid ammonium sulfate solution and applying a variable DC voltage between the brush and substrate.

To produce attractive color anodized surface finishes, an article of manufacture may be made of solid, elemental titanium prepared by hydrofluoric acid etching prior to the electrochemical anodization process. The resulting process, however, has two limitations in the need for the hydrofluoric acid etch and in the need for an elemental titanium substrate. It is well known that hydrofluoric acid is highly corrosive, dangerous to use and is virtually restricted to use with cast or plate cut articles only. Accordingly, where it is desired that the articles be made of a drawn substrate or a substrate made from a metal other than titanium, the aforesaid color anodization process cannot be achieved.

SUMMARY OF THE INVENTION

Therefore, the purpose of the present invention is to provide a new and improved method of preparing articles of manufacture for ornamental color anodization. In one aspect of the present invention, a metallic substrate consisting of either brass, overcoated with a layer of nickel, or stainless steel is coated with a layer of elemental niobium. With a surface coating of elemental niobium, the article may thereafter be color anodized by conventional methods, without the need for a hydrofluoric etch step, producing a highly attractive and colorful surface finish. The above and other objects and advantages of the present invention will be more readily apparent to those skilled in the art from a reading of the following detailed description by way of specific examples of the invention.

DESCRIPTION OF THE PREFERRED EMBODIMENT

Performed articles made from brass or stainless steel may be produced by standard manufacturing methods including stamping or drawing. The articles may have a polished or linished finish. By well-known electroplating techniques, the articles, if of brass, are thereafter coated with a layer of nickel, preferrably in a range between two to five microns in thickness.

Sputter etching of the articles can be accomplished within 15 minutes, in an evacuated chamber, filled with Argon to a pressure of $1.8\times10^{-2}$mbar followed by the application of a 1.6 kilowatt RF bias to the substrate. Thereafter, the articles are overcoated with a layer of elemental niobium to a thickness of between one to five microns using cathodic sputtering methods. In the latter step, sputtering may be effectively performed by lowering the pressure to $6.0\times10^{-3}$mbar and maintaining a sputter target power of 6.4 watts per square centimeter and a RF substrate bias of 1.35 Kilowatt. At such parameters, deposition of the niobium overcoat layer would be completed acceptably within 2 hours. The use of elemental niobium eliminates alloy contamination which will adversely alter the color appearance upon anodization. Following the sputtering deposition step, the articles are tri-chlor degreased and then rinsed in clean water at 6–7 pH. The articles are thus suitably prepared for color anodization by conventional processes, after which they can be coated with clear epoxy or a sputter deposited transparent ceramic coating for added wear resistance.

It should be appreciated that the foregoing method offers the distinct advantages of permitting color anodization to be performed on a wide variety of preformed articles in addition to cast or plate-cut forms. By eliminating the hydrofluoric etch step, heretofore required in color anodization, such articles will not be damaged by the corrosive effects of hydrofluoric acid etching, which can cause pinholes to be formed in the substrate as the surface coating is consumed. Moreover, with a sputter deposited surface coating of niobium, substrates may be attractively color anodized more safely and less expensively than heretofore possible.

While only a single embodiment of the present invention has been described, it will be understood that other changes and modifications may occur to those skilled in the art and it is contemplated by the appended claims to cover all such changes and modifications as fall within the true spirit and scope of the present invention.

What is claimed as new and desired to be secured by Letters Patent of the United States is:

1. A method of forming an ornamental coating on an article of manufacture comprising the steps of:

providing a substrate having a metallic surface consisting of the metal brass;

plating said surface with a first layer of nickel to a thickness of between two to five microns;

sputter-depositing over said first layer a second layer of niobium to a thickness of between one to five microns;

cleaning said second layer; and color anodizing said second layer in a solution of ammonium sulphate and water.

2. The method of claim 1 comprising the further step of overcoating said second layer with a layer of clear epoxy after said step of color anodizing said second layer.

3. The method of claim 1 comprising the further step of overcoating said second layer with a layer of transparent ceramic after said step of color anodizing said second layer.

4. A method of forming an ornamental coating on an article of manufacture comprising the steps of:

providing a substrate having a metallic surface consisting of the metal brass;

plating said surface with a first layer of nickel to a thickness of between two to five microns;

sputter-depositing over said first layer a second layer of niobium to a thickness of between one to five microns;

cleaning said second layer; and color anodizing said second layer in a solution of ammonium sulphate and water, said second layer being maintained free from contact with acid prior to the step of color anodizing said second layer.

5. A method of forming an ornamental coating on an article of manufacture comprising the steps of:

providing a substrate having a metallic surface consisting of the metal stainless steel;

sputter-depositing over said surface a first layer of niobium to a thickness of between one to five microns;

cleaning said coating in a water-base cleaner; and color anodizing said coating in a solution of ammonium sulphate and water.

* * * * *